US011703011B1

(12) United States Patent
Yamada

(10) Patent No.: US 11,703,011 B1
(45) Date of Patent: Jul. 18, 2023

(54) INTERNAL COMBUSTION ENGINE

(71) Applicant: TOYOTA JIDOSHA KABUSHIKI KAISHA, Toyota (JP)

(72) Inventor: Ryo Yamada, Ebina (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/147,253

(22) Filed: Dec. 28, 2022

(30) Foreign Application Priority Data

Mar. 28, 2022 (JP) ..... 2022-051643

(51) Int. Cl.
*F02D 41/30* (2006.01)
*F02P 5/15* (2006.01)
*F02D 41/40* (2006.01)

(52) U.S. Cl.
CPC ..... *F02D 41/3029* (2013.01); *F02D 41/3094* (2013.01); *F02D 41/402* (2013.01); *F02P 5/1502* (2013.01)

(58) Field of Classification Search
CPC ..... F02D 41/3029; F02D 41/3094; F02D 41/402; F02P 5/1502
USPC ..... 123/298, 299, 300, 305, 436, 431, 443; 701/103–105, 110
See application file for complete search history.

(56) References Cited

U.S. PATENT DOCUMENTS

2020/0109682 A1 4/2020 Kassai et al.

FOREIGN PATENT DOCUMENTS

WO WO 2018/229932 A1 12/2018

OTHER PUBLICATIONS

U.S. Appl. No. 17/929,039, filed Sep. 1, 2022, Ryota Yamada.

*Primary Examiner* — Hai H Huynh
(74) *Attorney, Agent, or Firm* — Oblon, McClelland, Maier & Neustadt, L.L.P.

(57) ABSTRACT

An electronic control unit of an internal combustion engine is configured to, when cooling fuel is supplied to a combustion chamber, calculate a target amount of supply of the cooling fuel and calculate a first upper limit injection amount that is an upper limit of an amount of fuel allowed to be injected from a second valve as the cooling fuel, when the target amount of supply is less than or equal to the first upper limit injection amount, supply the cooling fuel in the entire target amount of supply from the second valve to the combustion chamber in a first mode in which single-stage injection is performed, and, when the target amount of supply is greater than the first upper limit injection amount, supply the cooling fuel to the combustion chamber in a second mode in which the cooling fuel more easily diffuses than in the first mode.

12 Claims, 7 Drawing Sheets

INTERNAL COMBUSTION ENGINE

CROSS-REFERENCE TO RELATED APPLICATION

This application claims priority to Japanese Patent Application No. 2022-051643 filed on Mar. 28, 2022, incorporated herein by reference in its entirety.

BACKGROUND

1. Technical Field

The present disclosure relates to an internal combustion engine.

2. Description of Related Art

WO 2018/229932 describes an existing internal combustion engine. To form and burn stratified air-fuel mixture with an excess air ratio of about 2.0 (an excess air ratio in the range of 28 to 32 in terms of air-fuel ratio), the internal combustion engine is configured to form a homogeneous air-fuel mixture by injecting part of fuel per one combustion cycle at a first timing in a period including an intake stroke and the first half of a compression stroke and to form an ignition air-fuel mixture by injecting at least part of the remaining fuel at a second timing just before an ignition timing in a period including the second half of the compression stroke.

SUMMARY

The amount of NOx emissions is reduced by performing lean burn in which an air-fuel mixture leaner than a stoichiometric air-fuel ratio is formed in the entire combustion chamber and burned. As in the case of the existing internal combustion engine, when an ignition air-fuel mixture richer than a surrounding homogeneous air-fuel mixture is temporarily formed near an ignition plug by injecting ignition fuel in a compression stroke and then the ignition air-fuel mixture is ignited, lean burn is stabilized by reducing occurrence of a misfire even when lean burn is performed.

As the excess air ratio of the ignition air-fuel mixture is reduced by increasing the injection amount of ignition fuel that is injected from an in-cylinder fuel injection valve (as the air-fuel ratio of the ignition air-fuel mixture becomes richer), lean burn is stabilized but the amount of NOx emissions increases. A regulated value of the amount of NOx emissions is expected to become increasingly strict in the future, so the injection amount of ignition fuel is desirably as small as possible.

On the other hand, if the in-cylinder fuel injection valve is configured to inject just a small amount of ignition fuel for forming an ignition air-fuel mixture, there are concerns that the in-cylinder fuel injection valve is not sufficiently cooled by the latent heat of vaporization at the time of fuel injection and, as a result, the injection performance of the in-cylinder fuel injection valve decreases. For this reason, when the cooling effect caused by the latent heat of vaporization is intended to be attained, such as when there is a request to cool the in-cylinder fuel injection valve or when there is a request to cool the inside of a cylinder to avoid knocking, it is conceivable to inject cooling fuel in addition to ignition fuel from the in-cylinder fuel injection valve. However, with such a configuration, part of fuel for forming a homogeneous air-fuel mixture is injected from the in-cylinder fuel injection valve as cooling fuel, so there are concerns that the homogeneity of the homogeneous air-fuel mixture deteriorates.

The present disclosure suppresses the deterioration of homogeneity of a homogeneous air-fuel mixture in the case where cooling fuel is injected.

An aspect of the present disclosure relates to an internal combustion engine. The internal combustion engine includes an engine body, an ignition plug of which an electrode portion is disposed in a combustion chamber of the engine body, a first fuel injection valve configured to inject fuel into an intake passage of the engine body, a second fuel injection valve configured to inject fuel into the combustion chamber, and an electronic control unit. The electronic control unit is configured to, when lean burn is performed by injecting homogenization fuel for forming a homogeneous air-fuel mixture in the combustion chamber from the first fuel injection valve and injecting ignition fuel for forming an ignition air-fuel mixture near the electrode portion from the second fuel injection valve, supply part of the homogenization fuel to the combustion chamber as cooling fuel in accordance with an engine operating status. The electronic control unit is configured to, when the cooling fuel is supplied to the combustion chamber, calculate a target amount of supply of the cooling fuel and calculate a first upper limit injection amount that is an upper limit of an amount of fuel allowed to be injected from the second fuel injection valve as the cooling fuel. The electronic control unit is configured to, when the target amount of supply is less than or equal to the first upper limit injection amount, supply the cooling fuel in the entire target amount of supply from the second fuel injection valve to the combustion chamber in a first injection mode in which single-stage injection is performed. The electronic control unit is configured to, when the target amount of supply is greater than the first upper limit injection amount, supply the cooling fuel to the combustion chamber in a second injection mode in which the cooling fuel more easily diffuses than in the first injection mode.

According to the aspect of the present disclosure, when the cooling fuel in the entire target amount of supply is not completely injected from the second fuel injection valve in the first injection mode in which single-stage is performed, the cooling fuel is supplied to the combustion chamber in the second injection mode in which the cooling fuel more easily diffuses than in the first injection mode. Therefore, it is possible to suppress the deterioration of the homogeneity of homogeneous air-fuel mixture in the case where cooling fuel is injected.

In the internal combustion engine, in the second injection mode, the cooling fuel may be injected from the second fuel injection valve while an amount of fuel that is injected from the second fuel injection valve as the cooling fuel is limited to the first upper limit injection amount, and the cooling fuel in part or all of a remaining amount of supply obtained by subtracting the first upper limit injection amount from the target amount of supply may be injected from the first fuel injection valve in synchronization with an intake valve opening timing.

In the internal combustion engine, the electronic control unit may be further configured to, when the cooling fuel is supplied to the combustion chamber in the second injection mode, calculate a second upper limit injection amount that is an upper limit of an amount of fuel allowed to be injected from the first fuel injection valve as the cooling fuel, and, when the remaining amount of supply is greater than the second upper limit injection amount, limit an amount of fuel that is injected from the first fuel injection valve as the cooling fuel to less than or equal to the second upper limit injection amount.

In the internal combustion engine, the electronic control unit may be configured to, when the amount of fuel that is supplied from the first fuel injection valve as the cooling fuel is limited to less than or equal to the second upper limit injection amount, retard an ignition timing of the ignition fuel as compared to when the amount of fuel that is injected from the first fuel injection valve as the cooling fuel is not limited to less than or equal to the second upper limit injection amount.

In the internal combustion engine, the electronic control unit may be configured to, when the remaining amount of supply is less than or equal to the second upper limit injection amount, inject the cooling fuel in all of the remaining amount of supply from the first fuel injection valve in synchronization with the intake valve opening timing.

In the internal combustion engine, in the second injection mode, fuel at a pressure higher than a fuel pressure of fuel that is injected from the second fuel injection valve in the first injection mode may be injected in multiple stages from the second fuel injection valve as the cooling fuel.

In the internal combustion engine, the electronic control unit may be configured to, when an injection stop timing is later than a predetermined most retarded timing if the cooling fuel in all of the target amount of supply is injected from the second fuel injection valve in the second injection mode, limit an amount of fuel that is injected in the second injection mode to an amount of fuel allowed to be injected by the most retarded timing.

In the internal combustion engine, the electronic control unit may be configured to, when the amount of fuel that is injected in the second injection mode is limited to the amount of fuel allowed to be injected by the most retarded timing, retard an ignition timing of the ignition fuel as compared to when the amount of fuel that is injected in the second injection mode is not limited to the amount of fuel allowed to be injected by the most retarded timing.

In the internal combustion engine, the first upper limit injection amount may be an injection amount by which a homogeneity of the homogeneous air-fuel mixture at an ignition timing of the ignition fuel is maintained at a predetermined level or higher.

In the internal combustion engine, the second upper limit injection amount may be an injection amount by which a homogeneity of the homogeneous air-fuel mixture at an ignition timing of the ignition fuel is maintained at a predetermined level or higher.

In the internal combustion engine, the electronic control unit may be configured to perform the lean burn with an excess air ratio of 2.0 or higher.

In the internal combustion engine, the engine body may be configured to generate a tumble flow in the combustion chamber, and the tumble flow flows in a flow direction from a side adjacent to an intake port opening at a top surface of the combustion chamber toward an exhaust port and passes by the electrode portion, and the second fuel injection valve may be configured to directly inject fuel in the same direction as the flow direction of the tumble flow toward the electrode portion.

BRIEF DESCRIPTION OF THE DRAWINGS

Features, advantages, and technical and industrial significance of exemplary embodiments of the present disclosure will be described below with reference to the accompanying drawings, in which like signs denote like elements, and wherein.

DETAILED DESCRIPTION OF EMBODIMENTS

Figure 1:
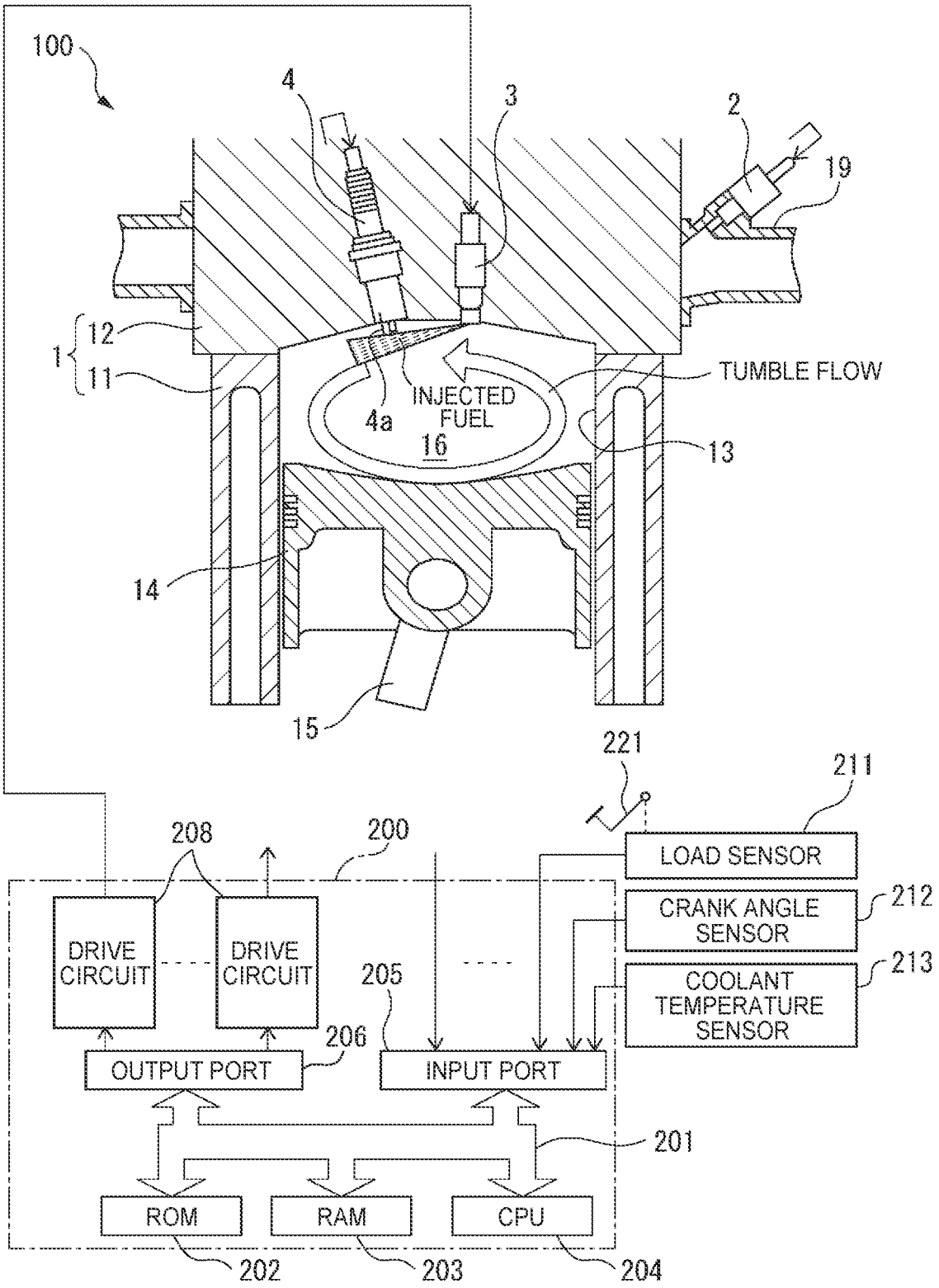
FIG. 1 is a schematic configuration diagram of an internal combustion engine of a spark ignition type and an electronic control unit configured to control the internal combustion engine according to a first embodiment of the present disclosure.

Hereinafter, embodiments of the present disclosure will be described in detail with reference to the accompanying drawings. In the following description, like reference numerals denote similar components.

FIG. 1 is a schematic configuration diagram of an internal combustion engine 100 of a spark ignition type according to an embodiment of the present disclosure.

As shown in FIG. 1, the internal combustion engine 100 includes an engine body 1, a first fuel injection valve 2, a second fuel injection valve 3, an ignition plug 4, and an electronic control unit 200.

The engine body 1 includes a cylinder block 11 and a cylinder head 12 fixed to the cylinder block 11.

Figure 2:
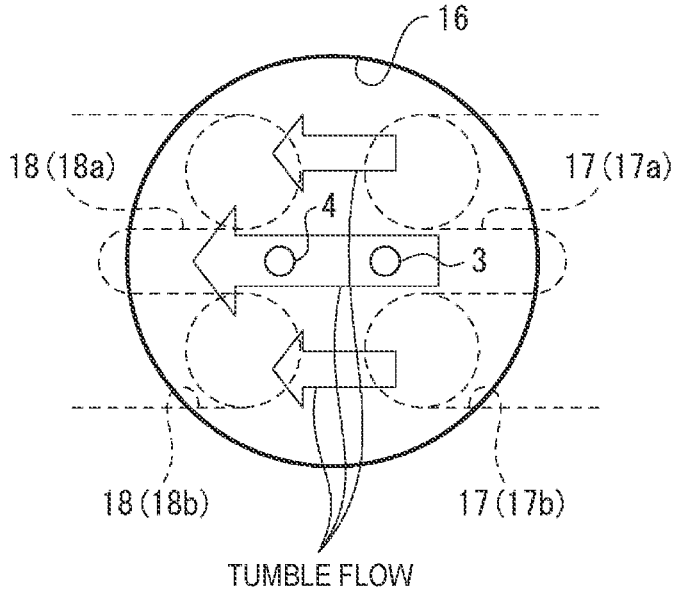
FIG. 2 is a schematic diagram when a combustion chamber is viewed from a cylinder head side.

At least one cylinder 13 is formed in the cylinder block 11. A piston 14 is accommodated in the cylinder 13. The piston 14 reciprocates in the cylinder 13 upon receiving combustion pressure. The piston 14 is coupled to a crankshaft (not shown) via a connecting rod 15. The reciprocating motion of the piston 14 is converted to rotational motion by the crankshaft. A space defined by the inner wall surface of the cylinder head 12, the inner wall surface of the cylinder 13, and the crown top surface of the piston 14 is a combustion chamber 16. FIG. 2 is a schematic diagram when the combustion chamber 16 is viewed from the cylinder head 12 side.

The cylinder head 12 has an intake port 17 (see FIG. 2) that is part of an intake passage, and an exhaust port 18 (see FIG. 2) that is part of an exhaust passage. The intake port 17 is bifurcated inside the cylinder head 12, and the pair of bifurcated intake ports 17*a*, 17*b* is open to the combustion chamber 16. The exhaust port 18 is bifurcated inside the cylinder head 12, and the pair of bifurcated exhaust ports 18*a*, 18*b* is open to the combustion chamber 16.

In the present embodiment, a tumble flow is configured to be formed in the combustion chamber 16 from intake air flowing into the combustion chamber 16 via the intake port 17 by adjusting the sectional shape of the intake port 17 or the sectional shape of the combustion chamber 16 or both. As indicated by the arrow in FIG. 1, a tumble flow according to the present embodiment flows from the intake port 17 into the combustion chamber 16, initially flows from the intake port 17 side (right side in the drawing) toward the exhaust port 18 side (left side in the drawing) along the top surface of the combustion chamber 16 (the inner wall surface of the cylinder head 12), and then flows toward the piston 14 along the inner wall surface of the cylinder 13 adjacent to the exhaust port 18. The tumble flow flows along the crown top surface of the piston 14 from the exhaust port 18 side toward the intake port 17 side and then flows along the inner wall surface of the cylinder 13 adjacent to the intake port 17.

A method of forming a tumble flow in the combustion chamber 16 is not limited to a method of adjusting the sectional shape of the intake port 17 or the sectional shape of the combustion chamber 16 or both. The method may be, for example, a method of forming a tumble flow by providing a control valve disposed in the intake port 17 and configured to generate uneven flow of intake air flowing through the intake port 17 and then adjusting the opening degree of the control valve.

Although not shown in the drawing, intake valves each used to open and close the opening between the combustion chamber 16 and a corresponding one of the intake ports 17*a*, 17*b*, exhaust valves each used to open and close the opening between the combustion chamber 16 and a corresponding one of the exhaust ports 18*a*, 18*b*, an intake camshaft configured to drive the opening and closing of the intake valves, and an exhaust camshaft configured to drive the opening and closing of the exhaust valves are mounted on the cylinder head 12.

The first fuel injection valve 2 is, for example, attached to an intake manifold 19 that is a part of the intake passage such that fuel can be injected into the intake port 17. The valve opening duration (injection amount) and valve opening timing (injection timing) of the first fuel injection valve 2 are changed in accordance with a control signal from the electronic control unit 200. When the first fuel injection valve 2 is opened, fuel is injected from the first fuel injection valve 2 into the intake port 17, and the fuel is supplied to the combustion chamber 16. The first fuel injection valve 2 may be mounted on, for example, the cylinder head 12 so as to be able to directly inject fuel into the combustion chamber 16.

The second fuel injection valve 3 is mounted on the cylinder head 12 so as to be able to inject fuel in the same direction as the flow direction of tumble flow flowing from the intake port 17 side toward the exhaust port 18 side along the crown top surface of the combustion chamber 16 and to directly inject fuel toward a space near the electrode portion 4*a* of the ignition plug 4. In the present embodiment, as shown in FIG. 2, the second fuel injection valve 3 is mounted between the intake ports 17*a*, 17*b*. The valve opening duration (injection amount) and valve opening timing (injection timing) of the second fuel injection valve 3 are changed in accordance with a control signal from the electronic control unit 200. When the second fuel injection valve 3 is opened, fuel is injected from the second fuel injection valve 3 into the combustion chamber 16, and the fuel is supplied to the combustion chamber 16.

The ignition plug 4 is mounted on the cylinder head 12 such that the electrode portion 4*a* is in the combustion chamber 16. In the present embodiment, as shown in FIG. 2, the ignition plug 4 is mounted between the exhaust ports 18*a*, 18*b*. The ignition plug 4 generates spark in the combustion chamber 16 to ignite an air-fuel mixture of fuel and air, formed in the combustion chamber 16. The ignition timing of the ignition plug 4 is controlled to a selected timing in accordance with a control signal from the electronic control unit 200.

The electronic control unit 200 is made up of a digital computer. The electronic control unit 200 includes a read only memory (ROM) 202, a random access memory (RAM) 203, a microprocessor (CPU) 204, an input port 205, and an output port 206 that are connected to one another via a bidirectional bus 201.

An output signal of a load sensor 211 is input to the input port 205 as a signal for detecting an engine load. The load sensor 211 generates an output voltage proportional to a depression amount of an accelerator pedal 221 (hereinafter, referred to as accelerator depression amount). An output signal of a crank angle sensor 212 is input to the input port 205 as a signal for calculating an engine rotation speed and the like. The crank angle sensor 212 generates an output pulse each time the crankshaft of the engine body 1 rotates 15°. An output signal of a coolant temperature sensor 213 is input to the input port 205 as a signal for detecting the temperature of the engine body 1. The coolant temperature sensor 213 detects the temperature of coolant (hereinafter, referred to as engine coolant temperature) for cooling the engine body 1. A signal for detecting the temperature of the engine body 1 is not limited to an output signal of the coolant temperature sensor 213. When, for example, an oil temperature sensor that detects the temperature of lubricating oil for lubricating friction sliding parts of the engine body 1 is provided, an output signal of the oil temperature sensor may be used. In this way, output signals of various sensors used to control the internal combustion engine 100 are input to the input port 205.

The output port 206 is connected to various controlled parts such as the first fuel injection valve 2, the second fuel injection valve 3, and the ignition plug 4 via corresponding drive circuits 208.

The electronic control unit 200 controls the internal combustion engine 100 by outputting control signals for controlling controlled parts from the output port 206 in accordance with output signals of various sensors, input to the input port 205.

Hereinafter, how the electronic control unit 200 controls the internal combustion engine 100 will be described.

The electronic control unit 200 switches the operation mode of the engine body 1 to a stoichiometric-burn mode or a lean-burn mode in accordance with the temperature of the engine body 1 (engine coolant temperature in the present embodiment). Specifically, the electronic control unit 200 switches the operation mode of the engine body 1 to the stoichiometric-burn mode when the temperature of the engine body 1 is lower than a predetermined temperature, that is, when the engine is cold and the ignitability of air-fuel mixture and, by extension, combustion stability, is relatively low. On the other hand, the electronic control unit 200 switches the operation mode of the engine body 1 to the lean-burn mode when the temperature of the engine body 1 is higher than or equal to the predetermined temperature.

When the operation mode is the stoichiometric-burn mode, the electronic control unit 200 operates the engine body 1 by performing homogeneous combustion in which a homogeneous air-fuel mixture with a stoichiometric air-fuel ratio or close to the stoichiometric air-fuel ratio is formed in the combustion chamber 16 and the homogeneous air-fuel mixture is ignited to cause flame propagation combustion.

Specifically, when the operation mode is the stoichiometric-burn mode, the electronic control unit 200 forms a homogeneous air-fuel mixture with the stoichiometric air-fuel ratio or close to the stoichiometric air-fuel ratio in the combustion chamber 16 by injecting fuel in a target fuel injection amount corresponding to a required torque from the first fuel injection valve 2 in a selected period from an exhaust stroke of the last combustion cycle to an intake stroke of the current combustion cycle. The electronic control unit 200 operates the engine body 1 by igniting the homogeneous air-fuel mixture with the ignition plug 4 at an optimal ignition timing (a knock limit timing when the optimal ignition timing is advanced with respect to the knock limit ignition timing) to cause flame propagation combustion.

On the other hand, when the operation mode is the lean-burn mode, the electronic control unit 200 operates the engine body 1 by performing lean burn in which a stratified air-fuel mixture is formed in the combustion chamber 16 and the stratified air-fuel mixture is ignited to cause flame propagation combustion. The stratified air-fuel mixture is leaner than the stoichiometric air-fuel ratio. In the stratified air-fuel mixture, an ignition air-fuel mixture (second air-fuel mixture) higher in fuel ratio than a surrounding air-fuel mixture (first air-fuel mixture) near the electrode portion 4*a* of the ignition plug 4 is unevenly present.

Figure 3:
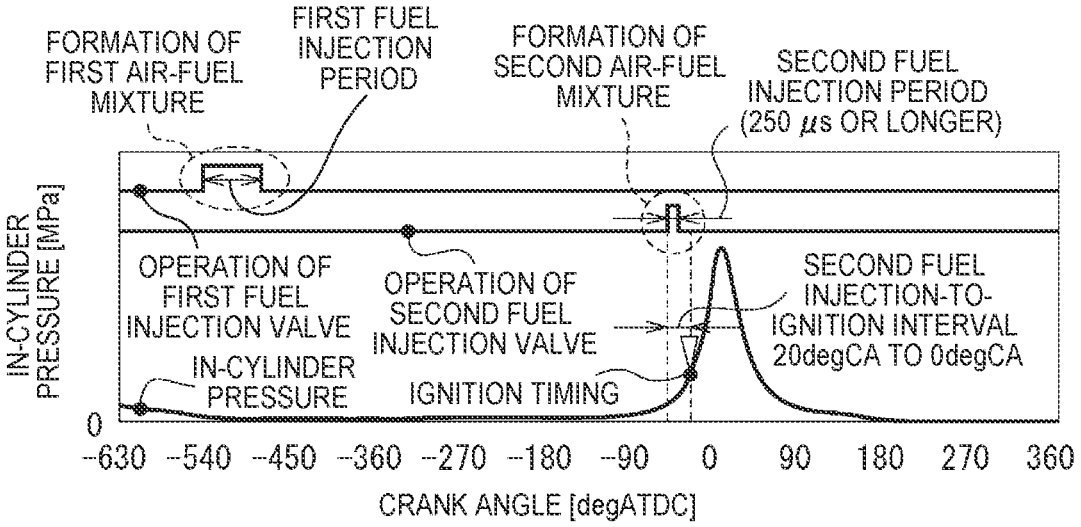
FIG. 3 is a timing chart showing an example of a fuel injection timing of a first fuel injection valve, a fuel injection timing of a second fuel injection valve, and an ignition timing in a lean-burn mode according to a first embodiment of the present disclosure where the ordinate axis represents in-cylinder pressure [MPa] and the abscissa axis represents crank angle [deg.ATDC]

FIG. 3 is a timing chart showing an example of the fuel injection timing of the first fuel injection valve 2, the fuel injection timing of the second fuel injection valve 3, and an ignition timing in the lean-burn mode where the ordinate axis represents in-cylinder pressure [MPa] and the abscissa axis represents crank angle [deg.ATDC].

As shown in FIG. 3, when the operation mode is the lean-burn mode, the electronic control unit 200 initially forms a homogeneous air-fuel mixture (hereinafter, referred to as first air-fuel mixture) leaner than the stoichiometric air-fuel ratio in the combustion chamber 16 by injecting first fuel from the first fuel injection valve 2 in a selected period from the exhaust stroke of the last combustion cycle to the intake stroke of the current combustion cycle to diffuse the first fuel over the entire combustion chamber 16.

Subsequently, the electronic control unit 200 injects second fuel (ignition fuel) for ignition assist from the second fuel injection valve 3 toward a space near the electrode portion 4*a* of the ignition plug 4 during a compression stroke (in the present embodiment, during a period from 20[deg.crank angle (CA)] before the ignition timing to the ignition timing) Thus, before the second fuel diffuses to the entire combustion chamber 16, an ignition air-fuel mixture (hereinafter, referred to as second air-fuel mixture) higher in fuel ratio than the first air-fuel mixture is temporarily formed near the electrode portion 4*a* of the ignition plug 4 to form a stratified air-fuel mixture in the combustion chamber 16. An excess air ratio Xo of the stratified air-fuel mixture is set to 2.0 or higher and, in the present embodiment, set to about 3.0. The electronic control unit 200 operates the engine body 1 by igniting the second air-fuel mixture to cause flame to propagate from the second air-fuel mixture to the first air-fuel mixture to thereby subject the stratified air-fuel mixture to flame propagation combustion.

In this way, by temporarily forming a second air-fuel mixture higher in fuel ratio near the electrode portion 4*a* of the ignition plug 4 and igniting the second air-fuel mixture, a misfire is reduced and the combustion stability of stratified air-fuel mixture is ensured even when a lean stratified air-fuel mixture of which an excess air ratio exceeds 2.0 is formed in the combustion chamber 16 as in the case of the present embodiment. As a stratified air-fuel mixture becomes leaner, the amount of NOx emissions is reduced by decreasing combustion temperature.

On the other hand, when the excess air ratio $\lambda_0$ of a stratified air-fuel mixture is the same, the combustion stability of a stratified air-fuel mixture improves as the excess air ratio $\lambda_2$ of a second air-fuel mixture is reduced (as the degree of richness of a second air-fuel mixture is increased). However, the combustion temperature of a second air-fuel mixture and, by extension, the combustion temperature of a stratified air-fuel mixture, increases, so the amount of NOx emissions increases.

Figure 4:
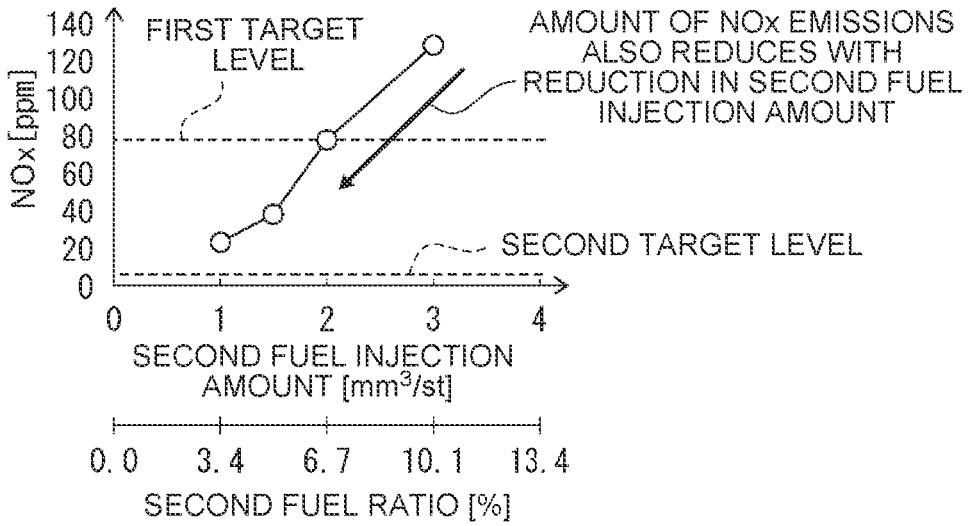
FIG. 4 is a graph showing a change in the amount of NOx emissions in the case where an engine load and an engine rotation speed are the same operating conditions and only a second fuel injection amount, that is, an excess air ratio of second air-fuel mixture, is changed while an average excess air ratio of air-fuel mixture in a combustion chamber remains unchanged.

FIG. 4 is a graph showing a change in the amount of NOx emissions in the case where the engine load and the engine rotation speed are the same operating conditions and only a second fuel injection amount [$mm^3$/stroke (st)] is changed while the excess air ratio $\lambda_0$ of a stratified air-fuel mixture (the average excess air ratio of an air-fuel mixture in the combustion chamber) remains unchanged (in this example, $\lambda_0$=2.7) to thereby change the ratio [%] of the second fuel injection amount to the total fuel injection amount (in this example, about 30 [$mm^3$/st]) (hereinafter, referred to as second fuel ratio), that is, in the case where only the excess air ratio $\lambda_2$ of the second air-fuel mixture is changed while the excess air ratio $\lambda_0$ of the stratified air-fuel mixture remains unchanged.

As shown in FIG. 4, as the second fuel ratio is decreased by reducing the second fuel injection amount, the degree of richness of the second air-fuel mixture also reduces. Therefore, the amount of NOx emissions is able to be reduced by decreasing the combustion temperature of the second air-fuel mixture and, by extension, the combustion temperature of the stratified air-fuel mixture.

In FIG. 4, a first target level and a second target level of the amount of NOx emissions in the lean-burn mode are indicated by the dashed lines. The first target level substantially corresponds to the amount of NOx emissions when, in the case where the amount of NOx emissions is reduced by performing lean homogeneous combustion to form a homogeneous air-fuel mixture leaner than the stoichiometric air-fuel ratio in the combustion chamber 16 to perform flame propagation combustion, the air-fuel ratio of the homogeneous air-fuel mixture is adjusted to a lean air-fuel ratio until ignition limit with spark ignition. The second target level is a target value of the amount of NOx emissions stricter than the first target level and corresponds to a regulated value of the amount of NOx emissions, determined by European emission standards (EURO7).

As shown in FIG. 4, to achieve the first target level, it appears that the second fuel injection amount should be reduced to less than or equal to about 2.0 [$mm^3$/st]. To achieve the second target level, it appears that the second fuel injection amount needs to be further reduced from the above amount.

In other words, to achieve the first target level, the minimum injection amount of the second fuel injection valve 3 needs to be less than or equal to a predetermined first injection amount by which the first target level is achieved. To achieve the second target level, the minimum injection amount of the second fuel injection valve 3 needs to be less than or equal to a predetermined second injection amount by which the second target level is achieved.

The "minimum injection amount" of the fuel injection valve is a minimum injection amount in a full-lift region of the fuel injection valve and is a total amount of fuel that is injected in a period of switching from a partial-lift region to the full-lift region, that is, in a period during which a lift amount of a needle valve (hereinafter, referred to as needle lift amount) of the fuel injection valve changes from zero to a maximum lift amount. The partial-lift region is an injection region of which the needle lift amount of the fuel injection valve is less than the maximum lift amount. The full-lift region is an injection region after the needle lift amount of the fuel injection valve becomes the maximum lift amount.

In the present embodiment, the needle lift amount of the second fuel injection valve 3, the diameter of injection holes, the number of injection holes, fuel pressure, and the like are adjusted such that the minimum injection amount of the second fuel injection valve 3 is less than a second injection amount and an injection amount per unit time (hereinafter, referred to as the rate of fuel injection) in the full-lift region of the second fuel injection valve 3 ranges from about 1.0 [$mm^3$/ms] to about 3.0 [$mm^3$/ms]. The reason why the rate of fuel injection of the second fuel injection valve 3 is adjusted to fall within a certain range in this way is as follows.

As the rate of fuel injection of the second fuel injection valve 3 is reduced, time taken until a predetermined amount of fuel is completely injected from the second fuel injection valve 3 extends. For this reason, if the rate of fuel injection is excessively reduced, the second fuel diffuses in the combustion chamber 16 while the second fuel is completely injected from the second fuel injection valve 3, and the excess air ratio $\lambda_2$ of the second air-fuel mixture is not able to be maintained at a predetermined excess air ratio $\lambda_{thr}$ or lower by which an air-fuel mixture is able to be stably ignited with the ignition plug 4. On the other hand, if the rate of fuel injection of the second fuel injection valve 3 is excessively increased, the second fuel injection amount is not able to be suppressed to less than or equal to the first injection amount or the second injection amount. In other words, if the rate of fuel injection of the second fuel injection valve 3 does not fall within a certain range, an appropriate second air-fuel mixture having an excess air ratio by which the air-fuel mixture is able to be stably ignited with the ignition plug 4 and the amount of NOx emissions is suppressed to lower than or equal to the first target level or the second target level is not able to be formed.

Incidentally, in the lean-burn mode, if only a small amount of second fuel (ignition fuel) for forming the second air-fuel mixture is injected from the second fuel injection valve 3, the second fuel injection valve 3 is not sufficiently cooled by the latent heat of vaporization at the time of fuel injection. When, for example, high-load operation continues, the second fuel injection valve 3 may have an excessively high temperature depending on engine operating conditions. As a result, for example, accumulation of deposit in the injection holes is facilitated or injection holes are thermally deformed, which may lead to a decrease in the injection performance of the second fuel injection valve 3.

Figure 5:
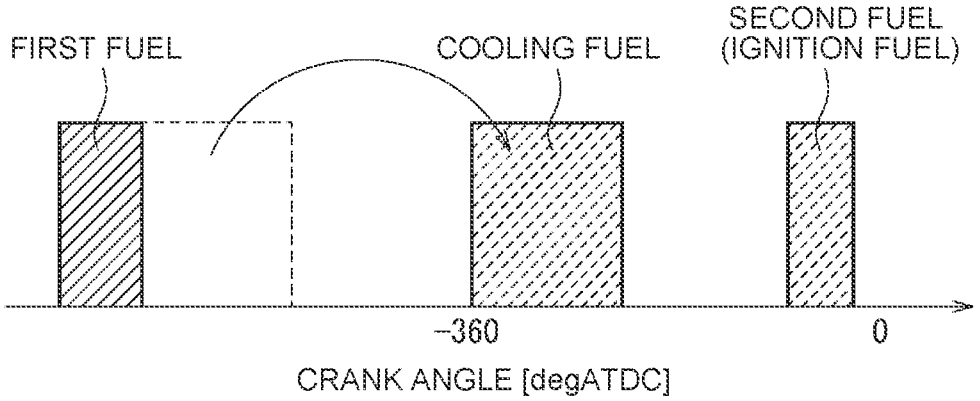
FIG. 5 is a graph showing examples of injection mode in which cooling fuel is injected.

When the second fuel injection valve 3 may have an excessively high temperature, part of first fuel that has been injected from the first fuel injection valve 2 is injected from the second fuel injection valve 3 as cooling fuel in addition to second fuel as shown in, for example, FIG. 5. Thus, the second fuel injection valve 3 is cooled by the latent heat of vaporization of the cooling fuel. Knocking may occur depending on engine operating conditions. In this case as well, part of first fuel that has been injected from the first fuel injection valve 2 is injected from the second fuel injection valve 3 as cooling fuel in addition to second fuel, knocking is suppressed by cooling the combustion chamber 16 or intake air with the latent heat of vaporization of the cooling fuel.

However, with such a configuration, part of first fuel for forming a first air-fuel mixture (homogeneous air-fuel mixture) is injected from the second fuel injection valve 3 as cooling fuel. In the present embodiment, to form an ignition second air-fuel mixture near the electrode portion 4*a* of the ignition plug 4, fuel injection with high directivity is performed from the second fuel injection valve 3 toward a space near the electrode portion 4*a* of the ignition plug 4. For this reason, if part of first fuel is injected from the second fuel injection valve 3 as cooling fuel, the cooling fuel is unevenly present in the injection direction of the second fuel injection valve 3, and poor mixture between fuel and air easily occurs in the combustion chamber 16. Therefore, as cooling fuel to be injected from the second fuel injection valve 3 is increased, the homogeneity of the first air-fuel mixture tends to deteriorate.

Figure 6:
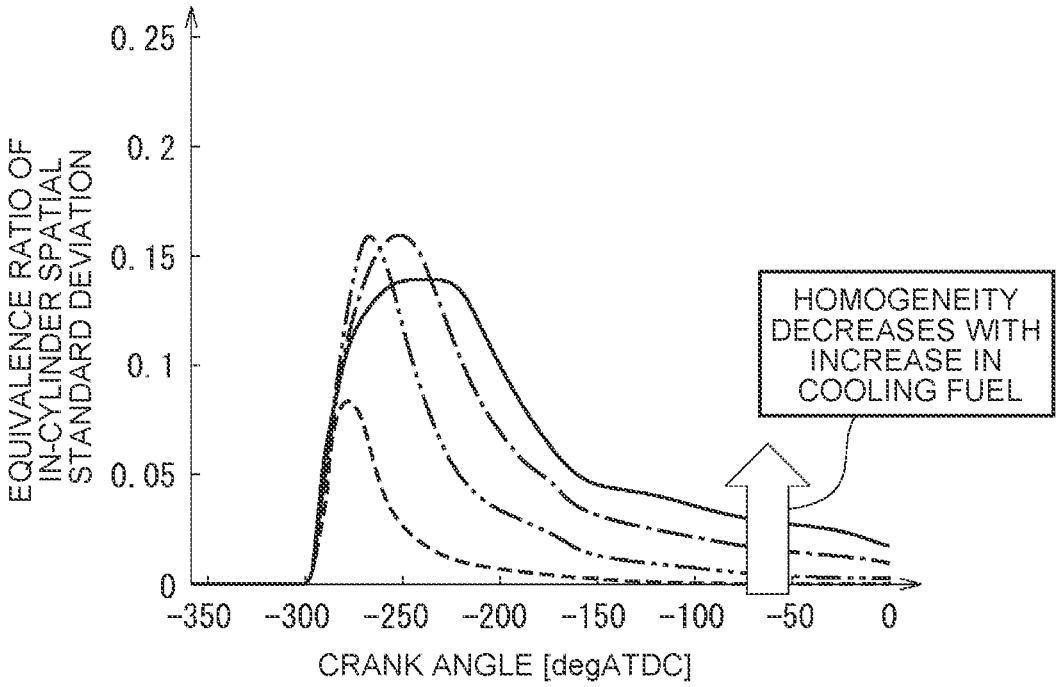
FIG. 6 is a graph showing a change in in-cylinder spatial standard deviation of equivalence ratio, which is an example of a parameter indicating the homogeneity of a first air-fuel mixture, for each injection amount of cooling fuel injected from the second fuel injection valve in the case where part of first fuel is injected from the second fuel injection valve as cooling fuel.

FIG. 6 is a graph showing a change in the spatial standard deviation (in-cylinder spatial standard deviation) of equivalence ratio in the combustion chamber 16, which is an example of a parameter indicating the homogeneity of the first air-fuel mixture, in the case where part of first fuel is injected from the second fuel injection valve 3 as cooling fuel for each injection amount of cooling fuel injected from the second fuel injection valve 3.

As shown in FIG. 6, as the injection amount of cooling fuel injected from the second fuel injection valve 3 increases, the in-cylinder spatial standard deviation before a compression top dead center near an ignition timing is large, so it appears that the homogeneity of the first air-fuel mixture has deteriorated. If the homogeneity of the first air-fuel mixture deteriorates in this way, combustion speed decreases, which may lead to a decrease in combustion efficiency, occurrence of knocking, deterioration of exhaust emissions, and the like.

Figure 7:
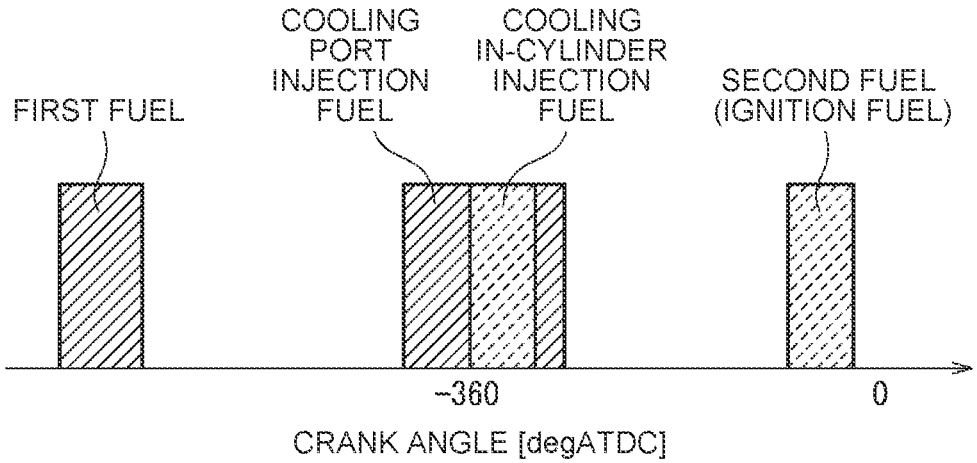
FIG. 7 is a graph illustrating an injection mode (first injection mode) according to the first embodiment of the present disclosure as an injection mode in which cooling fuel is injected.

For this reason, in the present embodiment, as shown in FIG. 7, the amount of fuel that is injected from the second fuel injection valve 3 as cooling fuel (cooling in-cylinder injection fuel) is limited to an injection amount by which the homogeneity of the first air-fuel mixture is maintained at a certain level or higher (in FIG. 6, an injection amount by which the in-cylinder spatial standard deviation near an ignition timing is set to a predetermined value or less). When the cooling effect is not sufficient only with cooling in-cylinder injection fuel, part or all of an insufficient amount of fuel (cooling port injection fuel) is injected from the first fuel injection valve 2 in addition to first fuel in synchronization with an intake valve opening timing (timing at which the cooling effect with the latent heat of vaporization is obtained by supplying fuel injected from the first fuel injection valve 2 into the combustion chamber 16 in a liquid form).

Fuel injected from the first fuel injection valve 2 more easily diffuses than fuel injected from the second fuel injection valve 3 that performs high-directivity fuel injection. For this reason, when the homogeneity of the first air-fuel mixture is intended to be maintained at a predetermined homogeneity, cooling fuel to be injected from the second fuel injection valve 3 is limited to a predetermined amount while an insufficient amount of cooling fuel is injected from the first fuel injection valve 2. Thus, in comparison with the case where cooling fuel is injected from only the second fuel injection valve 3, the amount of fuel allowed to be injected as cooling fuel is increased. Therefore, the homogeneity of the first air-fuel mixture is maintained at the predetermined homogeneity while the cooling effect with the latent heat of vaporization of cooling fuel is improved.

As shown in FIG. 5 and FIG. 7, the injection start timing of fuel that is injected from the second fuel injection valve 3 as cooling fuel (cooling in-cylinder injection fuel) is desirably later than −360[deg.ATDC]. This is because fuel that is injected from the second fuel injection valve 3 as cooling fuel (cooling in-cylinder injection fuel) is also fuel for forming a first air-fuel mixture with fuel that is injected from the first fuel injection valve 2 and is part of fuel for adjusting an engine output torque to a required torque. Therefore, if cooling fuel is injected into the combustion chamber 16 at the timing earlier than −360[deg.ATDC], that is, in the exhaust stroke in which the exhaust valves are open, the cooling fuel is exhausted to outside the combustion chamber 16 through the exhaust port 18, with the result that the engine output torque may decrease.

Figure 8:
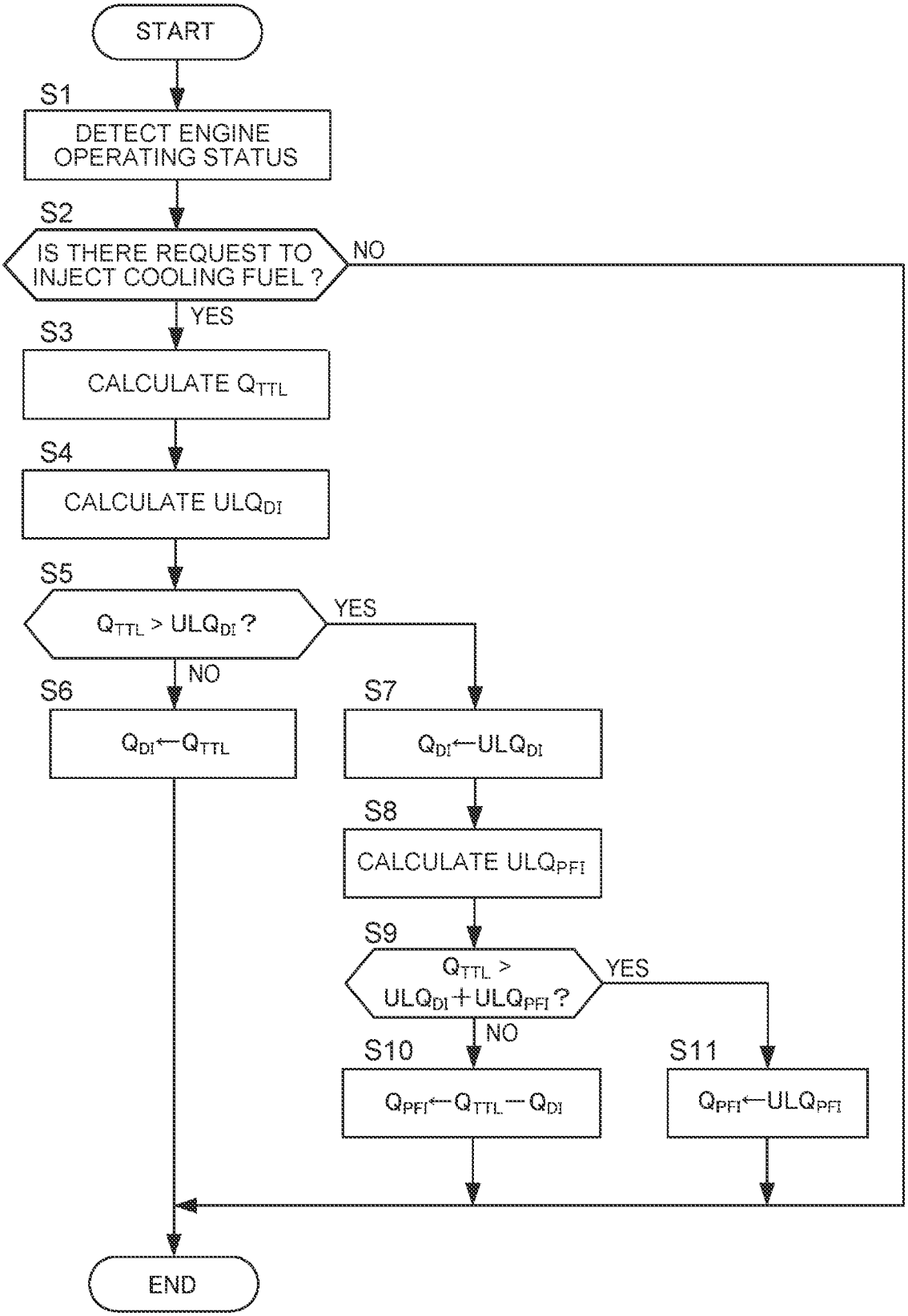
FIG. 8 is a flowchart illustrating a cooling fuel injection amount setting process according to the first embodiment of the present disclosure, which is executed in the lean-burn mode.

Hereinafter, a cooling fuel injection amount setting process that is executed in the lean-burn mode according to the present embodiment will be described with reference to the flowchart of FIG. 8. The electronic control unit 200 repeatedly executes the routine in the lean-burn mode at predetermined computation intervals.

In step S1, the electronic control unit 200 reads an engine rotation speed calculated based on an output signal of the crank angle sensor 212 and an engine load detected by the load sensor 211 and detects an engine operating status (an engine operating point determined by the engine rotation speed and the engine load).

In step S2, the electronic control unit 200 determines whether there is a request to inject cooling fuel. In the present embodiment, an operating range in which cooling fuel is injected is determined in advance by an experiment or the like, and, when the engine operating status falls within the operating range, the electronic control unit 200 determines that there is a request to inject cooling fuel. When there is no request to inject cooling fuel, the electronic control unit 200 ends the current process without setting the injection amount of cooling fuel. On the other hand, when there is a request to inject cooling fuel, the electronic control unit 200 advances the process to step S3.

In step S3, the electronic control unit 200 calculates the amount $Q_{TTL}$ of fuel required as cooling fuel (hereinafter, referred to as required cooling fuel amount). In the present embodiment, a required cooling fuel amount $Q_{TTL}$ corresponding to an engine operating status is determined in advance by an experiment or the like, and the electronic control unit 200 calculates a required cooling fuel amount $Q_{TTL}$ based on an engine operating status by consulting a map in which an engine operating status and a required cooling fuel amount $Q_{TTL}$ are associated with each other.

In step S4, the electronic control unit 200 calculates an upper limit $ULQ_{DI}$ of the amount of fuel allowed to be injected from the second fuel injection valve 3 as cooling fuel (hereinafter, referred to as upper limit in-cylinder injection amount). In the present embodiment, an upper limit in-cylinder injection amount $ULQ_{DI}$ corresponding to an engine operating status is determined in advance by an experiment or the like, and the electronic control unit 200 calculates an upper limit in-cylinder injection amount $ULQ_{DI}$ based on an engine operating status by consulting a map in which an engine operating status and an upper limit in-cylinder injection amount $ULQ_{DI}$ are associated with each other.

The upper limit in-cylinder injection amount $ULQ_{DI}$ is determined based on whether the homogeneity of the first air-fuel mixture near an ignition timing is maintained at a certain level or higher, so the upper limit in-cylinder injection amount $ULQ_{DI}$ changes in accordance with the intensity of tumble flow (that is, tumble ratio) that is formed in the combustion chamber 16. In other words, as the intensity of tumble flow formed in the combustion chamber 16 increases (that is, as the tumble ratio increases), fuel injected from the second fuel injection valve 3 more easily diffuses, so the upper limit in-cylinder injection amount $ULQ_{DI}$ is able to be increased. Therefore, in the present embodiment, in consideration of the intensity of tumble flow in each engine operating status, an appropriate upper limit in-cylinder injection amount $ULQ_{DI}$ corresponding to each engine operating status is determined by an experiment or the like. Easiness of diffusion of fuel injected from the second fuel injection valve 3 also comes under the influence of atomization characteristics of the second fuel injection valve 3 itself, such as the arrangement of the injection holes of the second fuel injection valve 3, so, of course, the atomization characteristics of the second fuel injection valve 3 itself are also considered in determining the upper limit in-cylinder injection amount $ULQ_{DI}$.

In step S5, the electronic control unit 200 determines whether the required cooling fuel amount $Q_{TTL}$ is greater than the upper limit in-cylinder injection amount $ULQ_{DI}$. When the required cooling fuel amount $Q_{TTL}$ is less than or equal to the upper limit in-cylinder injection amount $ULQ_{DI}$, the electronic control unit 200 determines that the homogeneity of the first air-fuel mixture is maintained at a certain level or higher even when all the cooling fuel is injected from the second fuel injection valve 3 and advances the process to step S6. On the other hand, when the required cooling fuel amount $Q_{TTL}$ is greater than the upper limit in-cylinder injection amount $ULQ_{DI}$, the electronic control unit 200 determines that the homogeneity of the first air-fuel mixture is not maintained at a certain level or higher if all the cooling fuel is injected from the second fuel injection valve 3 and advances the process to step S7.

In step S6, the electronic control unit 200 sets the amount $Q_{DI}$ of fuel that is injected from the second fuel injection valve 3 as cooling fuel (hereinafter, referred o as cooling in-cylinder injection amount) to the required cooling fuel amount $Q_{TTL}$.

In step S7, the electronic control unit 200 sets the cooling in-cylinder injection amount $Q_{DI}$ to the upper limit in-cylinder injection amount $ULQ_{DI}$.

In step S8, the electronic control unit 200 calculates an upper limit $ULQ_{PFI}$ of the amount of fuel allowed to be injected from the first fuel injection valve 2 as cooling fuel (hereinafter, referred to as upper limit port injection amount) in synchronization with an intake valve opening timing. In the present embodiment, an upper limit port injection amount $ULQ_{PFI}$ corresponding to an engine operating status is determined in advance by an experiment or the like, and the electronic control unit 200 calculates an upper limit port injection amount $ULQ_{PFI}$ based on an engine operating status by consulting a map in which an engine operating status and an upper limit port injection amount $ULQ_{PFI}$ are associated with each other.

The upper limit port injection amount $ULQ_{PFI}$ is also determined based on whether the homogeneity of the first air-fuel mixture near an ignition timing is maintained at a certain level or higher, so the upper limit in-cylinder injection amount $ULQ_{DI}$ changes in accordance with the intensity of tumble flow (that is, tumble ratio) that is formed in the combustion chamber 16. In other words, as the intensity of tumble flow formed in the combustion chamber 16 increases (that is, as the tumble ratio increases), fuel injected from the first fuel injection valve 2 and supplied to the combustion chamber 16 more easily diffuses in the combustion chamber 16, so the upper limit port injection amount $ULQ_{PFI}$ is able to be increased. Therefore, in the present embodiment, in consideration of the intensity of tumble flow in each engine operating status, an appropriate upper limit port injection amount $ULQ_{PFI}$ corresponding to each engine operating status is determined by an experiment or the like.

In step S9, the electronic control unit 200 determines whether the required cooling fuel amount $Q_{TTL}$ is greater than a sum ULQ of the upper limit in-cylinder injection amount $ULQ_{DI}$ and the upper limit port injection amount $ULQ_{PFI}$. When the required cooling fuel amount $Q_{TTL}$ is less than or equal to the sum ULQ, the electronic control unit 200 determines that the homogeneity of the first air-fuel mixture is maintained at a certain level or higher even when all of the remaining cooling fuel not completely injected from the second fuel injection valve 3 is injected from the first fuel injection valve 2 in synchronization with an intake valve opening timing and advances the process to step S10. On the other hand, when the required cooling fuel amount $Q_{TTL}$ is greater than the sum ULQ, the electronic control unit 200 determines that the homogeneity of the first air-fuel mixture is not maintained at a certain level or higher if all of the remaining cooling fuel not completely injected from the second fuel injection valve 3 is injected from the first fuel injection valve 2 in synchronization with an intake valve opening timing and advances the process to step S11.

In step S10, the electronic control unit 200 sets the amount $Q_{PFI}$ of fuel that is injected from the first fuel injection valve 2 as cooling fuel (hereinafter, referred to as cooling port injection amount) to a value obtained by subtracting the cooling in-cylinder injection amount $Q_{DI}$ from the required cooling fuel amount $Q_{TTL}$.

In step S11, the electronic control unit 200 sets the cooling port injection amount $Q_{PFI}$ to the upper limit port injection amount $ULQ_{PFI}$. When the process proceeds to step S11, all of the required cooling fuel amount $Q_{TTL}$ cannot be injected to maintain the homogeneity of the first air-fuel mixture at a certain level or higher, and, therefore, a desired cooling effect is not obtained. Therefore, it is desirable to additionally execute a process for compensating an insufficient cooling effect, that is, for example, a process in which an ignition timing set in accordance with an engine operating status is corrected to be retarded.

The internal combustion engine 100 according to the present embodiment described above includes the engine body 1, the ignition plug 4 of which the electrode portion 4*a* is disposed in the combustion chamber 16 of the engine body 1, the first fuel injection valve 2 configured to inject fuel into the intake passage of the engine body 1, the second fuel injection valve 3 configured to inject fuel into the combustion chamber 16, and the electronic control unit 200.

The electronic control unit 200 is configured to, when lean burn is performed by injecting homogenization fuel (first fuel) for forming a homogeneous air-fuel mixture (first air-fuel mixture) in the combustion chamber 16 from the first fuel injection valve 2 and injecting ignition fuel (second fuel) for forming an ignition air-fuel mixture (second air-fuel mixture) near the electrode portion 4*a* from the second fuel injection valve 3, supply part of the homogenization fuel to the combustion chamber 16 as cooling fuel in accordance with an engine operating status. The electronic control unit 200 is configured to, when the cooling fuel is supplied to the combustion chamber 16, calculate the target amount of supply of the cooling fuel (required cooling fuel amount $Q_{TTL}$) and calculate the first upper limit injection amount (upper limit in-cylinder injection amount $ULQ_{DI}$) that is the upper limit of the amount of fuel allowed to be injected from the second fuel injection valve 3 as the cooling fuel. The electronic control unit 200 is configured to, when the target amount of supply is less than or equal to the first upper limit injection amount, supply the cooling fuel in the entire target amount of supply from the second fuel injection valve 3 to the combustion chamber 16 in the first injection mode in which single-stage injection is performed. The electronic control unit 200 is configured to, when the target amount of supply is greater than the first upper limit injection amount, supply the cooling fuel to the combustion chamber 16 in the second injection mode in which the cooling fuel more easily diffuses than in the first injection mode.

In the present embodiment, in the second injection mode, the cooling fuel is injected from the second fuel injection valve 3 while the amount of fuel that is injected from the second fuel injection valve 3 as the cooling fuel is limited to the first upper limit injection amount (upper limit in-cylinder injection amount $ULQ_{DI}$), and the cooling fuel in part or all of the remaining amount of supply obtained by subtracting the first upper limit injection amount from the target amount of supply (required cooling fuel amount Qin) is injected from the first fuel injection valve 2 in synchronization with an intake valve opening timing.

Fuel that is injected from the first fuel injection valve 2 into the intake passage more easily diffuses than fuel that is injected from the second fuel injection valve 3 into the combustion chamber 16 with a high pressure. Particularly, in the present embodiment, since fuel injection with high directivity is performed from the second fuel injection valve 3 toward the electrode portion 4*a* of the ignition plug 4, fuel injected from the second fuel injection valve 3 is further difficult to diffuse. For this reason, when the homogeneity of the first air-fuel mixture is intended to be maintained at a predetermined homogeneity, cooling fuel to be injected from the second fuel injection valve 3 is limited while an insufficient amount is injected from the first fuel injection valve 2. Thus, in comparison with the case where cooling fuel is injected from only the second fuel injection valve 3, the amount of fuel allowed to be injected as cooling fuel is increased. Therefore, the homogeneity of the first air-fuel mixture is maintained at the predetermined homogeneity while the cooling effect with the latent heat of vaporization of cooling fuel is improved.

The electronic control unit 200 according to the present embodiment is configured to, when the cooling fuel is supplied to the combustion chamber 16 in the second injection mode, calculate the second upper limit injection amount (upper limit port injection amount $ULQ_{PFI}$) that is the upper limit of the amount of fuel allowed to be injected from the first fuel injection valve 2 as the cooling fuel. The electronic control unit 200 is configured to, when the remaining amount of supply obtained by subtracting the first upper limit injection amount (upper limit in-cylinder injection amount $ULQ_{DI}$) from the target amount of supply (required cooling fuel amount $Q_{TTL}$) is greater than the second upper limit injection amount, limit the amount of fuel that is injected from the first fuel injection valve 2 as the cooling fuel to less than or equal to the second upper limit injection amount.

Thus, it is possible to reduce a situation in which the homogeneity of the first air-fuel mixture is not maintained at a predetermined homogeneity.

The electronic control unit 200 according to the present embodiment is configured to, when the amount of fuel that is injected from the first fuel injection valve 2 as the cooling fuel is limited to less than or equal to the second upper limit injection amount (upper limit port injection amount $ULQ_{PFI}$), retard the ignition timing of ignition fuel as compared to when the amount of fuel that is injected from the first fuel injection valve 2 as the cooling fuel is not limited to less than or equal to the second upper limit injection amount (upper limit port injection amount $ULQ_{PFI}$).

Thus, the homogeneity of the first air-fuel mixture is maintained at a predetermined homogeneity while the cooling effect not sufficient only with the latent heat of vaporization of cooling fuel is compensated by retarding ignition.

The electronic control unit 200 according to the present embodiment is configured to, when the remaining amount of supply obtained by subtracting the first upper limit injection amount (upper limit in-cylinder injection amount $ULQ_{DI}$) from the target amount of supply (required cooling fuel amount $Q_{TTL}$) is less than or equal to the second upper limit injection amount (upper limit port injection amount $ULQ_{PFI}$), inject the cooling fuel in all of the remaining amount of supply from the first fuel injection valve 2 in synchronization with an intake valve opening timing.

Thus, the homogeneity of the first air-fuel mixture is maintained at a predetermined homogeneity while a necessary and sufficient cooing effect is obtained as the cooling effect with the latent heat of vaporization of cooling fuel.

Second Embodiment

Next, a second embodiment of the present disclosure will be described. The present embodiment differs from the first embodiment in that multiple-stage injection is performed as needed and cooling fuel is supplied from the second fuel injection valve 3 with an increased fuel pressure. Hereinafter, the difference will be mainly described. In the present embodiment, the fuel pressure of the second fuel injection valve 3 is configured to be able to be set to at least a first fuel pressure that is an initial setting and a second fuel pressure higher than the first fuel pressure. In the present embodiment, the second fuel pressure is a settable maximum fuel pressure.

Although described with reference to FIG. 5, as shown in the graph (A) of FIG. 9, when part of first fuel for forming a first air-fuel mixture, which has been injected from the first fuel injection valve 2, is injected from the second fuel injection valve 3 separately from second fuel (ignition fuel) as cooling fuel, it becomes more difficult to evenly disperse fuel in the combustion chamber 16 as the injection amount of cooling fuel is increased. Therefore, the homogeneity of the first air-fuel mixture deteriorates.

Figure 9:
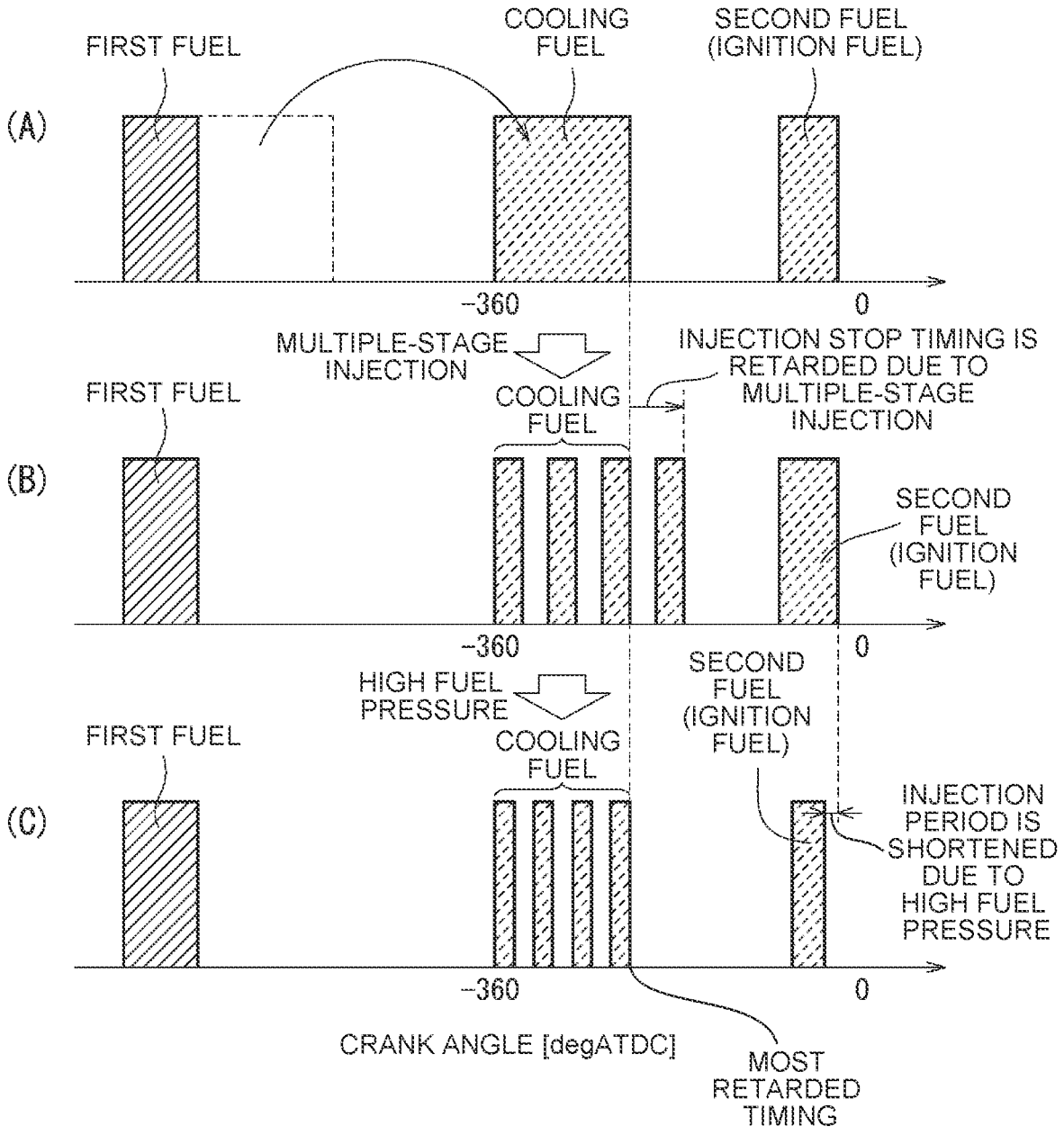
FIG. 9 shows graphs illustrating an injection mode (second injection mode) according to a second embodiment of the present disclosure, which is performed as an injection mode in which cooling fuel is injected.

In contrast, as shown in the graph (B) of FIG. 9, when cooling fuel that is injected from the second fuel injection valve 3 is injected in multiple stages, each fuel injected at an interval is more easily mixed with surrounding air. Therefore, the deterioration of the homogeneity of the first air-fuel mixture is suppressed by evenly dispersing fuel in the combustion chamber 16 as compared to single-stage injection. However, on the other hand, when multiple-stage injection is performed, an injection stop timing is retarded as compared to when the same amount of fuel is injected in a single stage (see the graph (A) of FIG. 9). As a result, there are concerns that the premixture time of cooling fuel is insufficient and, therefore, the deterioration of the homogeneity of the first air-fuel mixture is not suppressed.

In the present embodiment, as shown in the graph (C) of FIG. 9, when there is a request to inject cooling fuel, multiple-stage injection is performed and the rate of fuel injection is increased by increasing the fuel pressure in the second fuel injection valve 3. Thus, retardation of injection stop timing due to multiple-stage injection is suppressed while the injection stop timing of cooling fuel is limited by a predetermined most retarded timing.

The most retarded timing depends on easiness of diffusion of cooling fuel in a period from the most retarded timing to an ignition timing. Therefore, in consideration from the viewpoint of maintaining the homogeneity of the first air-fuel mixture at a certain level or higher, as the intensity of tumble flow formed in the combustion chamber 16 increases (that is, as the tumble ratio increases), the most retarded timing can be more retarded. In the present embodiment, the most retarded timing is fixed at −180[deg.ATDC]. Alternatively, the most retarded timing may be changed according to each engine operating status in consideration of the intensity of tumble flow in each engine operating status.

Figure 10:
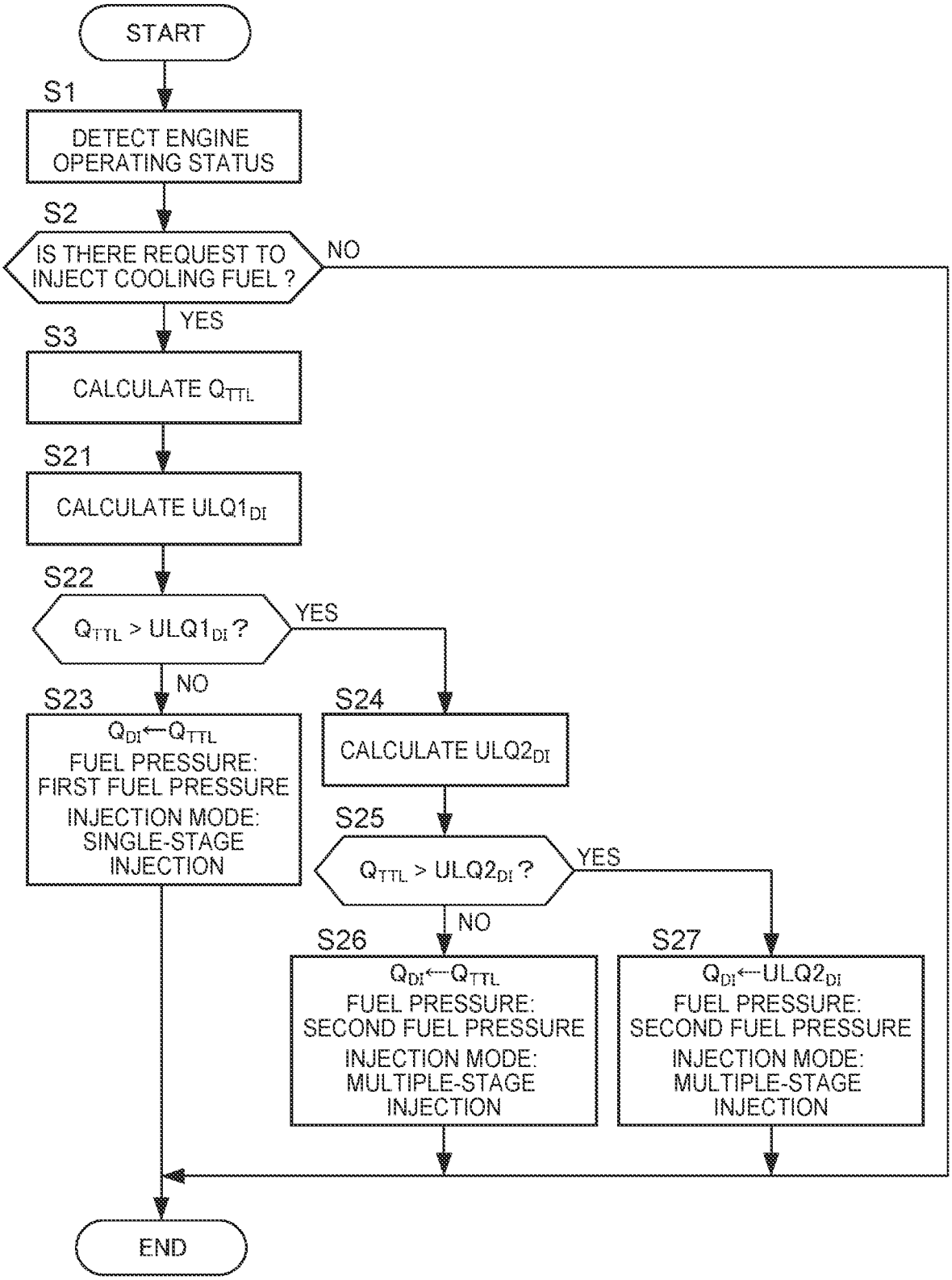
FIG. 10 is a flowchart illustrating a cooling fuel injection amount setting process according to the second embodiment of the present disclosure, which is executed in the lean-burn mode.

Hereinafter, a cooling fuel injection amount setting process that is executed in the lean-burn mode according to the present embodiment will be described with reference to the flowchart of FIG. 10. The electronic control unit 200 repeatedly executes the routine in the lean-burn mode at predetermined computation intervals. In FIG. 10, the details of the process from step S1 to step S3 are similar to those of the first embodiment, so the description is omitted here.

In step S21, the electronic control unit 200 calculates an upper limit $ULQ1_{DI}$ of the amount of fuel allowed to be injected from the second fuel injection valve 3 as the cooling fuel (hereinafter, referred to as first upper limit in-cylinder injection amount) at a first fuel pressure without performing multiple-stage injection. In the present embodiment, a first upper limit in-cylinder injection amount $ULQ1_{DI}$ corresponding to an engine operating status is determined in advance by an experiment or the like, and the electronic control unit 200 calculates a first upper limit in-cylinder injection amount $ULQ1_{DI}$ based on an engine operating status by consulting a map in which an engine operating status and a first upper limit in-cylinder injection amount $ULQ1_{DI}$ are associated with each other.

In step S22, the electronic control unit 200 determines whether the required cooling fuel amount $Q_{TTL}$ is greater than the first upper limit in-cylinder injection amount $ULQ1_{DI}$. When the required cooling fuel amount $Q_{TTL}$ is less than or equal to the first upper limit in-cylinder injection amount $ULQ1_{DI}$, the electronic control unit 200 determines that the homogeneity of the first air-fuel mixture is maintained at a certain level or higher even when cooling fuel is injected from the second fuel injection valve 3 without performing multiple-stage injection and advances the process to step S23. On the other hand, when the required cooling fuel amount $Q_{TTL}$, is greater than the first upper limit in-cylinder injection amount $ULQ1_{DI}$, the electronic control unit 200 determines that the homogeneity of the first air-fuel mixture is not maintained at a certain level or higher when cooling fuel is injected from the second fuel injection valve 3 without performing multiple-stage injection and advances the process to step S24.

In step S23, the electronic control unit 200 sets the cooling in-cylinder injection amount $Q_{DI}$ to the required cooling fuel amount $Q_{TTL}$. When the process proceeds to step S23, the electronic control unit 200 injects cooling fuel from the second fuel injection valve 3 at the first fuel pressure without performing multiple-stage injection.

In step S24, when the electronic control unit 200 sets the fuel pressure to the second fuel pressure and performs multiple-stage injection while limiting the injection stop timing by the most retarded timing, the electronic control unit 200 calculates an upper limit amount $ULQ2_{DI}$ of cooling fuel allowed to be injected from the second fuel injection valve 3 (hereinafter, referred to as second upper limit in-cylinder injection amount). As described above, by providing multiple stages of injection, each fuel injected at an interval is more easily mixed with surrounding air. By increasing the pressure of fuel, vaporization is facilitated by atomizing fuel, so each fuel is further more easily mixed with surrounding air. In this way, by providing multiple stages of injection and high fuel pressure, cooling fuel more easily diffuses, so the second upper limit in-cylinder injection amount $ULQ2_{DI}$ is greater than the first upper limit in-cylinder injection amount $ULQ1_{DI}$.

In step S25, the electronic control unit 200 determines whether the required cooling fuel amount $Q_{TTL}$ is greater than the second upper limit in-cylinder injection amount $ULQ2_{DI}$. When the required cooling fuel amount $Q_{TTL}$ is less than or equal to the second upper limit in-cylinder injection amount $ULQ2_{DI}$, the electronic control unit 200 determines that the homogeneity of the first air-fuel mixture is maintained at a certain level or higher by setting the fuel pressure to the second fuel pressure and performing multiple-stage injection, and advances the process to step S26. On the other hand, when the required cooling fuel amount $Q_{TTL}$ is greater than the second upper limit in-cylinder injection amount $ULQ2_{DI}$, the electronic control unit 200 determines that all of the cooling fuel is not able to be injected by the most retarded timing and the homogeneity of the first air-fuel mixture is not maintained at a certain level or higher when the fuel pressure is set to the second fuel pressure and multiple-stage injection is performed, and advances the process to step S27.

In step S26, the electronic control unit 200 sets the cooling in-cylinder injection amount $Q_{DI}$ to the required cooling fuel amount $Q_{TTL}$. When the process proceeds to step S26, the electronic control unit 200 injects cooling fuel from the second fuel injection valve 3 while increasing the fuel pressure to the second fuel pressure and performing multiple-stage injection.

In step S27, the electronic control unit 200 sets the cooling in-cylinder injection amount $Q_{DI}$ to the second upper limit in-cylinder injection amount $ULQ2_{DI}$. When the process proceeds to step S27 as well, the electronic control unit 200 injects cooling fuel from the second fuel injection valve 3 while increasing the fuel pressure to the second fuel pressure and performing multiple-stage injection. However, when the process proceeds to step S27, the injection stop timing is limited by the most retarded timing, so all of the required cooling fuel amount $Q_{TTL}$ is not able to be injected, and, as a result, a desired cooling effect is not obtained. Therefore, it is desirable to additionally execute a process for compensating an insufficient cooling effect, that is, for example, a process in which an ignition timing set in accordance with an engine operating status is corrected to be retarded.

According to the present embodiment described above, the electronic control unit 200 is configured to, when cooling fuel is supplied to the combustion chamber 16, calculate the target amount of supply of the cooling fuel (required cooling fuel amount $Q_{TTL}$) and calculate the first upper limit injection amount (first upper limit in-cylinder injection amount $ULQ1_{DI}$) that is the upper limit of the amount of fuel allowed to be injected from the second fuel injection valve 3 as the cooling fuel. The electronic control unit 200 is configured to, when the target amount of supply is less than or equal to the first upper limit injection amount, supply the cooling fuel in the entire target amount of supply from the second fuel injection valve 3 to the combustion chamber 16 in the first injection mode in which single-stage injection is performed. The electronic control unit 200 is configured to, when the target amount of supply is greater than the first upper limit injection amount, supply the cooling fuel to the combustion chamber 16 in the second injection mode in which the cooling fuel more easily diffuses than in the first injection mode.

In the present embodiment, in the second injection mode, fuel at a pressure higher than a fuel pressure of fuel that is injected from the second fuel injection valve 3 in the first injection mode is injected in multiple stages from the second fuel injection valve 3 as the cooling fuel.

As described above, by providing multiple stages of injection, each fuel injected at an interval is more easily mixed with surrounding air. By increasing the pressure of fuel, vaporization is facilitated by atomizing fuel, so each fuel is further more easily mixed with surrounding air. Therefore, by providing multiple stages of injection and high fuel pressure, the amount of fuel allowed to be injected as cooling fuel is able to be increased as in the case of the first embodiment. Therefore, the homogeneity of the first air-fuel mixture is maintained at the predetermined homogeneity while the cooling effect with the latent heat of vaporization of cooling fuel is improved.

When the injection stop timing is later than a predetermined most retarded timing if the cooling fuel in the entire target amount of supply (required cooling fuel amount $Q_{TTL}$) is injected from the second fuel injection valve 3 in the second injection mode, the electronic control unit 200 is configured to inject the amount of fuel allowed to be injected in the second injection mode by the most retarded timing.

Thus, it is possible to suppress a situation in which the homogeneity of the first air-fuel mixture is not maintained at a predetermined homogeneity due to a shortened premixture period from the most retarded timing to the ignition timing.

When the amount of fuel that is injected in the second injection mode to provide multiple-stage injection and high fuel pressure is limited to the amount of fuel allowed to be injected by the most retarded timing, the electronic control unit 200 according to the present embodiment is configured to retard the ignition timing of ignition fuel as compared to when the amount of fuel that is injected in the second injection mode is not limited to the amount of fuel allowed to be injected by the most retarded timing.

Thus, the homogeneity of the first air-fuel mixture is maintained at a predetermined homogeneity while the cooling effect not sufficient only with the latent heat of vaporization of cooling fuel is compensated by retarding ignition.

The embodiments of the present disclosure have been described above; however, the embodiments describe only some of application examples of the present disclosure and are not intended to limit the technical scope of the present disclosure to the specific configurations of the embodiments.

For example, in the above-described embodiments, lean burn setting the amount of fuel of second fuel (ignition fuel) to a small amount less than or equal to a first injection amount or a second injection amount does not need to be performed in all the engine operating range in which lean burn with an excess air ratio of 2.0 or higher is performed. For example, combustion stability may be ensured while lean burn may be performed only in a predetermined engine operating range in which emissions of NOx are intended to be suppressed.

In the above-described embodiments, the reason why the first fuel injection valve 2 for forming a homogeneous air-fuel mixture in the combustion chamber 16 is provided separately from the second fuel injection valve 3 for forming an ignition air-fuel mixture in the combustion chamber 16 is as follows.

As described above, to form an appropriate second air-fuel mixture with an excess air ratio, which is able to be stably ignited with the ignition plug 4 and suppress the amount of NOx emissions to less than or equal to the first target level or the second target level, the rate of fuel injection of the second fuel injection valve 3 needs to fall within a certain range.

In the case where the rate of fuel injection of the second fuel injection valve 3 is adjusted to fall within a certain range, if first fuel for forming a homogeneous air-fuel mixture in the combustion chamber 16 is intended to be injected by the second fuel injection valve 3 separately from second fuel without providing the first fuel injection valve 2, the rate of fuel injection is too low and all the amount of fuel needed to form a homogeneous air-fuel mixture is not able to be completely injected within a fuel injection period in which the homogeneous air-fuel mixture can be formed when a required torque increases to increase a target fuel injection amount, that is, when the amount of fuel for forming a homogeneous air-fuel mixture (that is, first amount of fuel) that is injected from the second fuel injection valve 3 increases. For this reason, in the above-described embodiments, the first fuel injection valve 2 for forming a homogeneous air-fuel mixture in the combustion chamber 16 and the second fuel injection valve 3 for forming an ignition air-fuel mixture in the combustion chamber 16 are used together.

What is claimed is:

1. An internal combustion engine comprising:

an engine body;

an ignition plug of which an electrode portion is disposed in a combustion chamber of the engine body;

a first fuel injection valve configured to inject fuel into a suction passage of the engine body;

a second fuel injection valve configured to inject fuel into the combustion chamber; and an electronic control unit configured to when lean burn is performed by injecting homogenization fuel for forming a homogeneous air-fuel mixture in the combustion chamber from the first fuel injection valve and injecting ignition fuel for forming an ignition air-fuel mixture near the electrode portion from the second fuel injection valve, supply part of the homogenization fuel to the combustion chamber as cooling fuel in accordance with an engine operating status, when the cooling fuel is supplied to the combustion chamber, calculate a target amount of supply of the cooling fuel and calculate a first upper limit injection amount that is an upper limit of an amount of fuel allowed to be injected from the second fuel injection valve as the cooling fuel, when the target amount of supply is less than or equal to the first upper limit injection amount, supply the cooling fuel in the entire target amount of supply from the second fuel injection valve to the combustion chamber in a first injection mode in which single-stage injection is performed, and when the target amount of supply is greater than the first upper limit injection amount, supply the cooling fuel to the combustion chamber in a second injection mode in which the cooling fuel more easily diffuses than in the first injection mode.

2. The internal combustion engine according to claim 1, wherein, in the second injection mode, the cooling fuel is injected from the second fuel injection valve while an amount of fuel that is injected from the second fuel injection valve as the cooling fuel is limited to the first upper limit injection amount, and the cooling fuel in part or all of a remaining amount of supply obtained by subtracting the first upper limit injection amount from the target amount of supply is injected from the first fuel injection valve in synchronization with an intake valve opening timing.

3. The internal combustion engine according to claim 2, wherein the electronic control unit is further configured to when the cooling fuel is supplied to the combustion chamber in the second injection mode, calculate a second upper limit injection amount that is an upper limit of an amount of fuel allowed to be injected from the first fuel injection valve as the cooling fuel, and when the remaining amount of supply is greater than the second upper limit injection amount, limit an amount of fuel that is injected from the first fuel injection valve as the cooling fuel to less than or equal to the second upper limit injection amount.

4. The internal combustion engine according to claim 3, wherein the electronic control unit is configured to, when the amount of fuel that is supplied from the first fuel injection valve as the cooling fuel is limited to less than or equal to the second upper limit injection amount, retard an ignition timing of the ignition fuel as compared to when the amount of fuel that is injected from the first fuel injection valve as the cooling fuel is not limited to less than or equal to the second upper limit injection amount.

5. The internal combustion engine according to claim 3, wherein the electronic control unit is configured to, when the remaining amount of supply is less than or equal to the second upper limit injection amount, inject the cooling fuel in all of the remaining amount of supply from the first fuel injection valve in synchronization with the intake valve opening timing.

6. The internal combustion engine according to claim 3, wherein the second upper limit injection amount is an injection amount by which a homogeneity of the homogeneous air-fuel mixture at an ignition timing of the ignition fuel is maintained at a predetermined level or higher.

7. The internal combustion engine according to claim 1, wherein, in the second injection mode, fuel at a pressure higher than a fuel pressure of fuel that is injected from the second fuel injection valve in the first injection mode is injected in multiple stages from the second fuel injection valve as the cooling fuel.

8. The internal combustion engine according to claim 7, wherein the electronic control unit is configured to, when an injection stop timing is later than a predetermined most retarded timing if the cooling fuel in all of the target amount of supply is injected from the second fuel injection valve in the second injection mode, limit an amount of fuel that is injected in the second injection mode to an amount of fuel allowed to be injected by the most retarded timing.

9. The internal combustion engine according to claim 8, wherein the electronic control unit is configured to, when the amount of fuel that is injected in the second injection mode is limited to the amount of fuel allowed to be injected by the most retarded timing, retard an ignition timing of the ignition fuel as compared to when the amount of fuel that is injected in the second injection mode is not limited to the amount of fuel allowed to be injected by the most retarded timing.

10. The internal combustion engine according to claim 1, wherein the first upper limit injection amount is an injection amount by which a homogeneity of the homogeneous air-fuel mixture at an ignition timing of the ignition fuel is maintained at a predetermined level or higher.

11. The internal combustion engine according to claim 1, wherein the electronic control unit is configured to perform the lean burn with an excess air ratio of 2.0 or higher.

12. The internal combustion engine according to claim 1, wherein:

the engine body is configured to generate a tumble flow in the combustion chamber, and the tumble flow flows in a flow direction from a side adjacent to an intake port opening at a top surface of the combustion chamber toward an exhaust port and passes by the electrode portion; and the second fuel injection valve is configured to directly inject fuel in the same direction as the flow direction of the tumble flow toward the electrode portion.

* * * * *